US005159768A

United States Patent [19]

Longo, Jr.

[11] Patent Number: 5,159,768

[45] Date of Patent: Nov. 3, 1992

[54] SHOE WITH MUSIC GENERATING UNIT IN THE TONGUE

[75] Inventor: Anthony J. Longo, Jr., Pequea, Pa.

[73] Assignee: Tiny-ettes Infant Shoes, Inc., Columbia, Pa.

[21] Appl. No.: 750,206

[22] Filed: Aug. 27, 1991

[51] Int. Cl.[5] ..... A43B 23/00

[52] U.S. Cl. ..... 36/139; 36/54; 36/136

[58] Field of Search ..... 36/139, 132, 136, 54, 36/137

[56] References Cited

U.S. PATENT DOCUMENTS

| | | | |
|---|---|---|---|
| 2,160,756 | 5/1939 | Schreck | 36/139 |
| 3,018,570 | 1/1962 | Bliese | 36/1 |
| 4,043,241 | 8/1977 | Liu | 36/139 |
| 4,253,254 | 3/1981 | Gill | 36/139 |
| 4,372,060 | 2/1983 | Adamik | 36/136 |
| 4,630,383 | 12/1986 | Gamm | 36/54 |
| 4,711,043 | 12/1987 | Johnson | 36/139 |
| 4,787,100 | 11/1988 | Jonat | 36/139 |
| 4,955,150 | 9/1990 | Fagan | 36/136 |

*Primary Examiner*—Paul T. Sewell
*Assistant Examiner*—Thomas P. Hilliard
*Attorney, Agent, or Firm*—Howson and Howson

[57] ABSTRACT

A musical shoe having a squeeze-activated tone generator concealed in an upper portion of the tongue of the shoe. A seam across the tongue below the upper portion provides a relatively flexible hinge about the instep which permits an operator's fingers to be inserted between the tongue portion and the ankle joint for squeezing the generator. Perforations in the tongue portion permit a message stored in memory in the generator to be transmitted.

1 Claim, 1 Drawing Sheet

SHOE WITH MUSIC GENERATING UNIT IN THE TONGUE

BACKGROUND OF THE INVENTION

The present invention relates generally to shoes and attachments therefor, and more particularly to children's shoes incorporating a pressure-activated tone generator for emitting music, voice messages, or like sounds.

In addition to providing improvements in comfort and wear of shoes, the manufacturer may seek unique and appealing features for adding to a shoe in order to capture the fancy of the consumer. This is especially true with footwear for infants and children where amusing features on shoes are often tantamount criteria to the buyer. Indeed, some of these features may also serve functional purposes. For example, colorful reflectors or illuminators on sneakers or jogging shoes also offer greater visibility on dark thoroughfares and highways. Another device alerts the wearer with an audible signal when the shoe becomes loose and is about to slip off. In U.S. Pat. No. 4,771,556 to Young J. Kim, for example, an electronically stored melody is emitted when a fastening strap over the shoe loosens and exposes a photovoltaic cell to light. Similarly, in U.S. Pat. No. 4,646,350 to Batra a microcircuit in the fold of a shoe strap activates an audible message when the strap is fastened or loosened. Neither of these systems are designed to allow amusing interludes at times other than when the shoe is fastened or loosened. This is because the activating element is substantially inaccessible for an operator's fingers while the shoe is properly fastened on the foot. Consequently, the playful novelty of the shoe is significantly limited.

SUMMARY OF THE INVENTION

Accordingly, it is an object of the present invention to provide a novel and improved acoustic shoe which can be readily manipulated at any time while the shoe is secured on the foot for delivering an audible signal such as a voice message or tune stored in memory.

Still another object is to provide a musical shoe which will emit an entertaining nursery tune from a shoe while completely secured on an infant's foot.

Still another object is to provide a pressure-activated acoustical device within a shoe of the type having conventional fasteners such as buckles, straps, or shoelaces.

A still further object is to provide a novel and improved shoe with an integral acoustic amusement device which is substantially hidden from view, but which is readily accessible for squeezing between an operator's fingers.

Briefly, these and other objects and aspects of the invention are accomplished in a shoe for a foot. The shoe includes a tongue secured to the instep of the shoe with a portion located adjacent to the ankle joint. A pressure-activated, tone generator is concealed in the tongue portion above a relatively flexible region of the tongue for permitting fingers be inserted beneath the tongue portion and applying an activating pressure. At least one aperture in registry with the generator in the tongue portion transmits sounds such as a cheerful message or tune stored in memory when the device is activated.

BRIEF DESCRIPTION OF THE DRAWINGS

For a better understanding of the invention, reference will be made to the following detailed description taken in conjunction with the accompanying drawings.

DESCRIPTION OF THE PREFERRED EMBODIMENT

Figure 1:
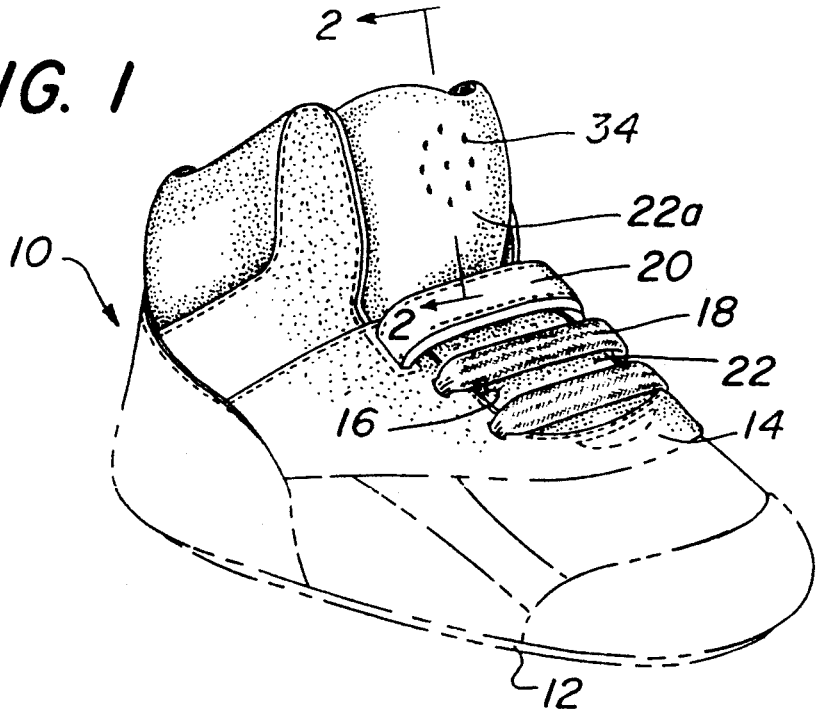
FIG. 1 is a perspective view of a shoe according to the invention with an acoustic device concealed in the tongue.

Referring now to the drawings wherein like characters designate like or corresponding parts throughout the several views, there is shown in FIG. 1 an infant's shoe 10 generally comprising a sole 12 and instep 14 with a throat 16. Shoe 10 may be secured on the foot such as by a shoelace 18 and a hook-and-loop fastened strap 18 drawn across throat 16. A tongue 22, hinged at one end to instep 14 at the bottom of throat 16, extends along upper surface of the arch of the foot and terminates with an upper portion **22*a* adjacent to the ankle joint above shoelace 18 and strap 20** when the shoe is on the foot.

Figure 2:
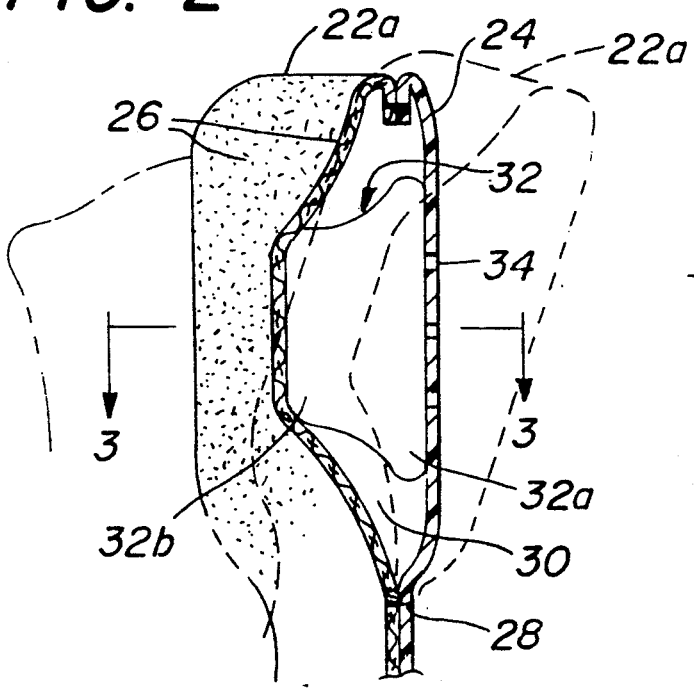
FIG. 2 is a view in cross section of the tongue of the shoe of FIG. 1 in a plane taken along the line 2—2.
Figure 3:
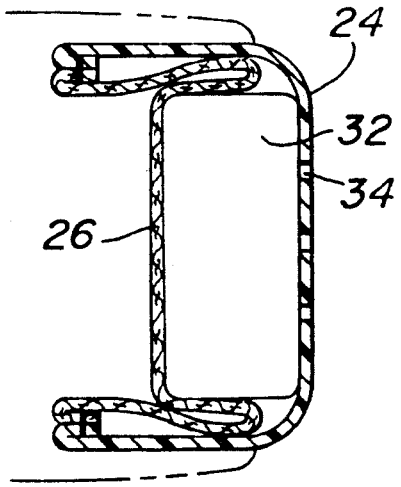
FIG. 3 is a view in cross section of the tongue of FIG. 2 in a plane taken along the line 3—3.

As best seen in FIGS. 2 and 3, tongue 22 is fabricated with an outer panel 24, preferably of a compliant leather or vinyl plastic, seamed in any convenient manner along the side edges and upper edge to a liner 26, preferably of a soft knitted or woven fabric. Panel 24 and liner 26 are also joined crosswise along a seam 28 located approximately on the boundary between instep 14 and upper portion **22*a* to form a hinge line about which the upper portion 22*a* may bend more readily. Side margins of tongue 22 underlap instep 14 along the sides of throat 16 and fold inwardly at the upper portion 22*a* to form a pocket 30 between panel 24 and liner 26 bounded by the folds, seam 28, and the upper edge. Tongue 22 has sufficient flexibility at seam 28 to allow an operator to place the fingers simultaneously on both sides of the upper portion 22*a* and squeeze generator 30** without unfastening the shoe from the foot.

A pressure-activated, battery-powered tone generator 32 is permanently implanted within pocket 30 with a sound emitting side **32*a* and pressure point 32*b* contiguous with interior walls of outer panel 24 and liner 26, respectively. Generator 32** is a commercially available product which plays back a sound, such as randomly selected voice messages or tunes stored in memory, when the opposite sides are squeezed.

Outer panel 24 preferably includes a cluster of perforations 34 registering with sound-emitting side **32*a* of device 30** to improve transmission from the shoe.

The shoe may be fabricated in different sizes to fit children and adult as well as infants, and in other forms of footwear such as slippers, moccasins, and loafers.

Some of the many advantages of the invention should now be readily apparent. For example, a novel shoe, appealing to people of all ages, is provided which includes a concealed acoustic device which is selectively actuated for generating a tone. It is intended for use in various types of shoes, but is particularly applicable for providing a cheerful tune in an infant's or child's shoe. The acoustic device is mounted in the shoe in a position where it can be easily manipulated while the shoe is fastened on the foot, and where will not interfere with normal activity.

It will be understood that various other changes in the details, steps and arrangement of parts, which have been herein described and illustrated in order to explain the nature of the invention, may be made by those skilled in the art within the principal and scope of the invention as expressed in the appended claims.

I claim:

1. In a shoe for an infant's foot, the shoe having an instep, a throat along the instep, a tongue formed of flexible inner and outer panels hinged and attached only at one end to the instep and extending along the entire length of the throat, said tongue being freely pivotable about said hinged end, and means extending across the thorat adjacent said hinged end of said tongue for releasably fastening the shoe to an infant's foot, the improvement comprising:

pocket means provided in said tongue above said hinged end thereof;

a pressure-activated, battery-powered music-generating unit disposed within said pocket means; and means forming at least one aperture in said outer tongue panel for transmitting sounds emitted by said unit in response to pressure transmitted through said pocket means to said unit;

said hinged tongue cooperating with said releasable fastening means to enable said pocket means to be pivoted forwardly while the shoe is on an infant's foot to enable the pocket to be squeezed for activating the music-generated unit.

* * * * *